United States Patent [19]

Tsukasaki

[11] 4,041,849

[45] Aug. 16, 1977

[54] APPARATUS FOR FOLDING CARTON SHEET

[76] Inventor: Yasuhiro Tsukasaki, 2-19, 4-chome, Higashikagaya, Suminoe, Osaka, Japan

[21] Appl. No.: 703,590

[22] Filed: July 8, 1976

[30] Foreign Application Priority Data

July 11, 1975 Japan ..... 50-85653
Mar. 26, 1976 Japan ..... 51-34016

[51] Int. Cl.[2] ..... B31B 1/56
[52] U.S. Cl. ..... 93/52; 93/49 R
[58] Field of Search ..... 93/52, 49 R, 84 R, 45, 93/48, 36 R; 53/376

[56] References Cited

U.S. PATENT DOCUMENTS

| | | | |
|---|---|---|---|
| 3,085,480 | 4/1963 | Kauffman et al. | 93/52 |
| 3,291,007 | 12/1966 | McDowell | 93/52 X |
| 3,396,508 | 8/1968 | Dorfmann | 93/52 X |
| 3,800,677 | 4/1974 | Jones et al. | 93/49 R X |
| 3,850,085 | 11/1974 | Klemm | 93/52 X |

*Primary Examiner*—James F. Coan
*Attorney, Agent, or Firm*—McGlew and Tuttle

[57] ABSTRACT

An apparatus and method for folding a container blank from a first channel shape to a final flat parallelogram shape by guiding the container blank along two parallel rails, past a plurality of grooved folding rollers, which are rotatably mounted at spaced locations along the rails. The rollers have top flange portions which abut the top of the container blank adjacent the folded edge and side faces abuting the container blank on the outer surface of the channel adjacent the folded edge, the side faces being increasingly inclined toward the container blank in the direction of motion of the blank along the rails to gradually fold the channel portion of the container blank back as the blank passes the rollers and forms the flattened parallelogram shape. The rollers may be separable into a top flange portion and a bottom side face portion which are adjustably engageable with each other to form grooves of varying depth to accommodate container blanks of varying thickness.

6 Claims, 14 Drawing Figures

APPARATUS FOR FOLDING CARTON SHEET

FIELD AND BACKGROUND OF THE INVENTION

This invention relates in general to a method and apparatus for folding cardboard or fiberboard blanks and, in particular, to a new and useful method and apparatus for folding side flaps of a container blank back upon a central container panel.

DESCRIPTION OF THE PRIOR ART

In a process for making cardboard boxes and the like, a flat container blank is slotted on its top and bottom surfaces near opposite edges to form two side flaps and a central panel and a score line is applied to the blank in order to fold the flaps downwardly and form a hinge or fold. The blank, with its flap portions substantially perpendicular to its central portion, is then folded into a flattened parallelogram shape by folding the flaps back upon the central portion and the opposite edges of the flap portions are glued together. The container can then be completed by opening the flattened parallelogram and interfolding the respective edge flaps.

In known folding processes, a plate or belt which is twisted from a vertical to a horizontal position has been provided adjacent the hinges or folds of the container blank. As the blank is moved past the plate or belt, the flaps are folded back upon the central portion of the container blank by the twisting action of the plate or belt. The flattened parallelogram is thus formed and the container-forming process can continue.

A problem with this known method is that, due to weakness in the container blank material near the score line, an improper fold often results. If the final fold fails to follow the score line, the blank will not be formed into a true parallelogram and the final container will be lop-sided with unequal and unparallel sides. Additionally, in the case where an automatic box-making device is used to make the container, problems may arise in that a slightly misformed blank will jam the machine or cause a total failure in the box-making process.

SUMMARY OF THE INVENTION

The inventive apparatus and method comprises, supplying a container blank which has been formed with folding lines and slots along lateral edges and has been pre-folded into a channel shape along these lines, to form edge flaps connected through a fold or hinge to a central portion or panel, to parellel guide rails which are provided adjacent the hinges or folds of the container blank. The blank is then transferred past a plurality of grooved rollers on opposite sides of the blank adjacent the hinges. These rollers have lower portions with successively increasing inclines in the direction of movement of the blank on the rails. The container blank is embraced between the rails and the rollers adjacent the hinges of the blank as it moves along the rails and, due to the increasing incline of the respective rollers, the blank is folded so that the flaps fold back upon the central portion or panel of the blank. In this form, the opposite edges of the flaps can be glued together in a subsequent operation.

In order to accommodate container blanks of various thicknesses, the grooved rollers may be formed into upper roller portions and lower roller portions which are adjustably engageable with each other to form grooves of varying depth and thus accommodate the blanks of varying thickness.

An object of the invention is to provide a folding method for container blanks by which correct folding can be made along prescribed folding score lines on the blank.

Another object of the present invention is to provide an apparatus which can fold container blanks exactly and smmothly without using twisted plates or belts.

A further object of the invention is to provide an apparatus by which an optimum folding operation can be practiced in accordance with varying thicknesses of container blanks.

In addition to the above mentioned objects, a further object of the invention is to provide a method and apparatus for folding container blanks which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
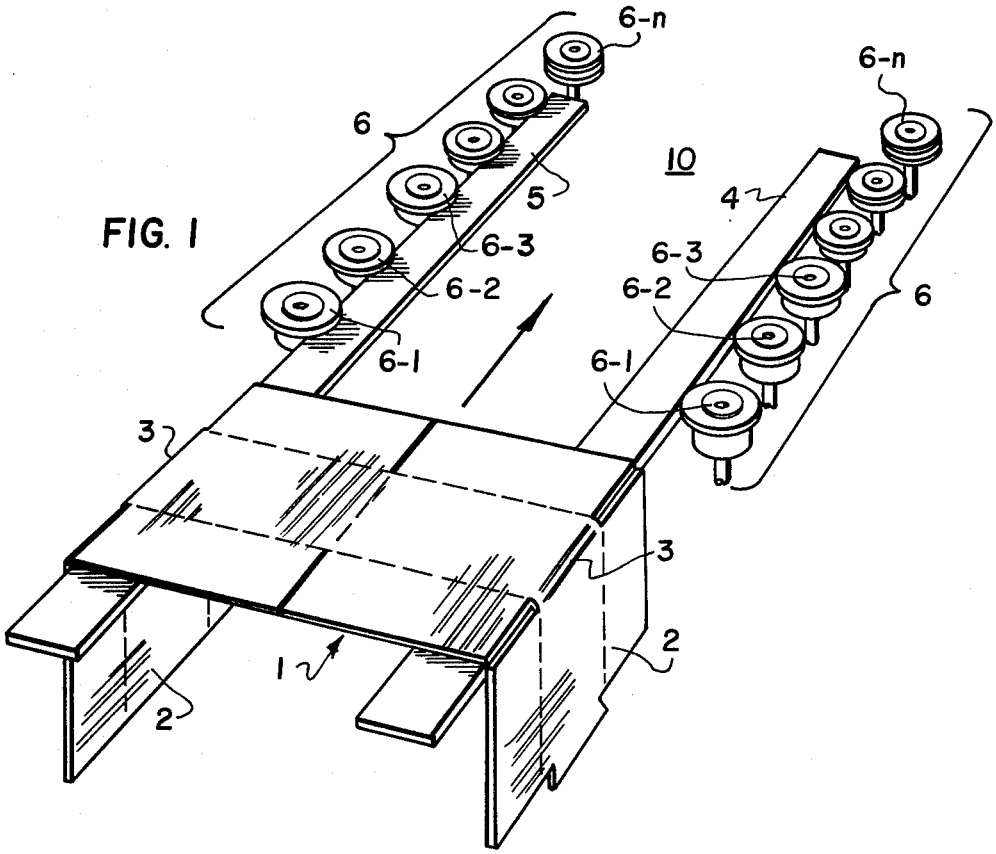
FIG. 1 is a schematic perspective view of the folding apparatus in which a plurality of rollers are arranged according to the present invention.
Figure 3:
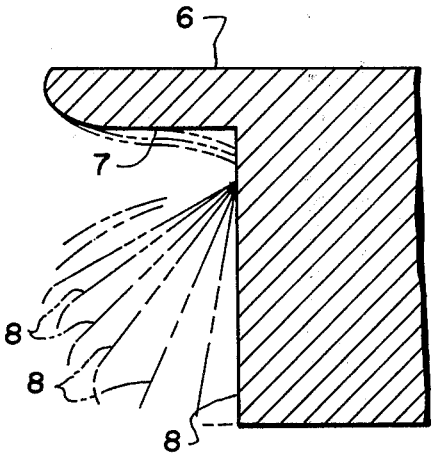
FIGS. 2 and 3 are explanatory drawings showing crosssectional views of the folding grooves as they successively close on the container blank during a folding operation.
Figure 2:
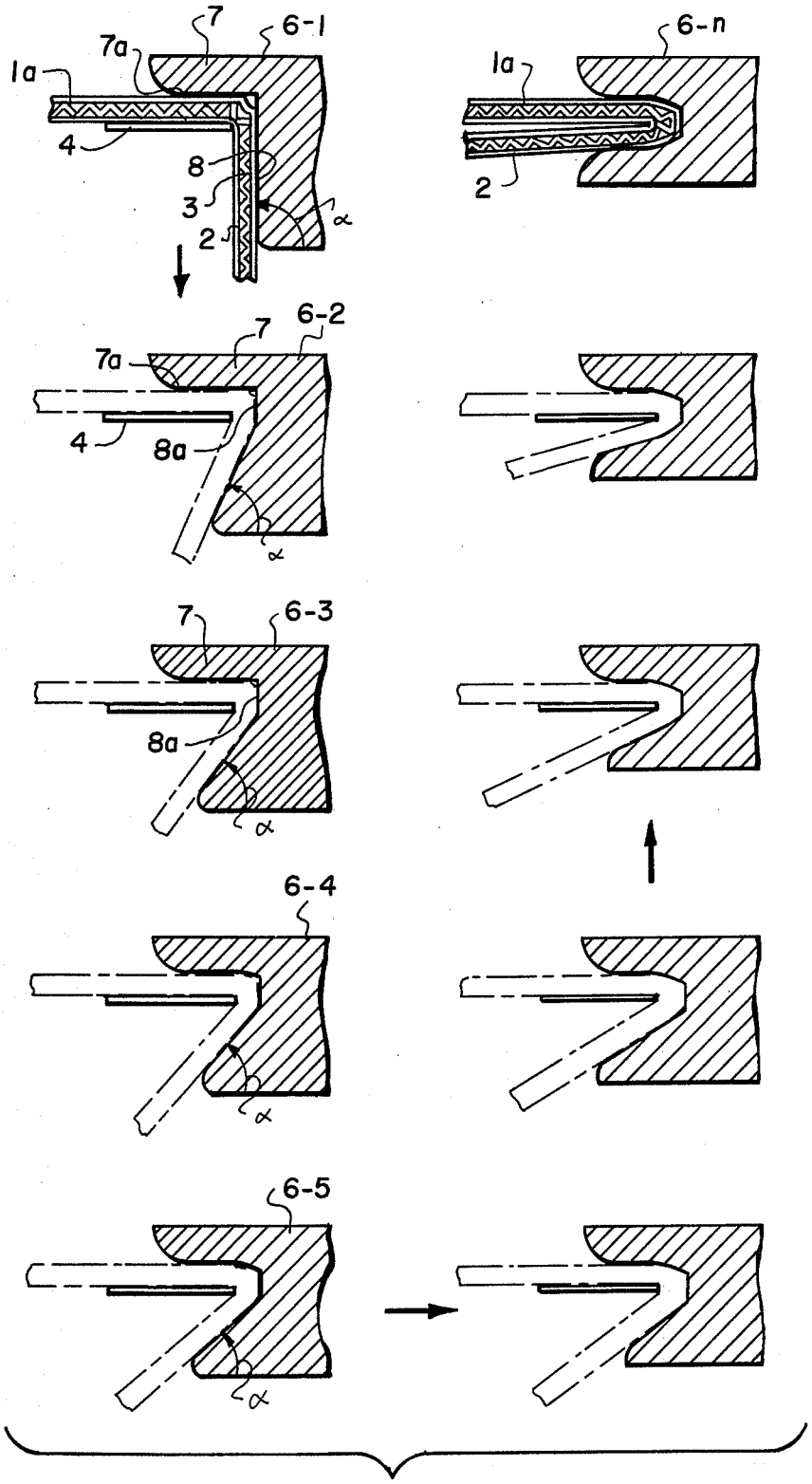
Figure 4:
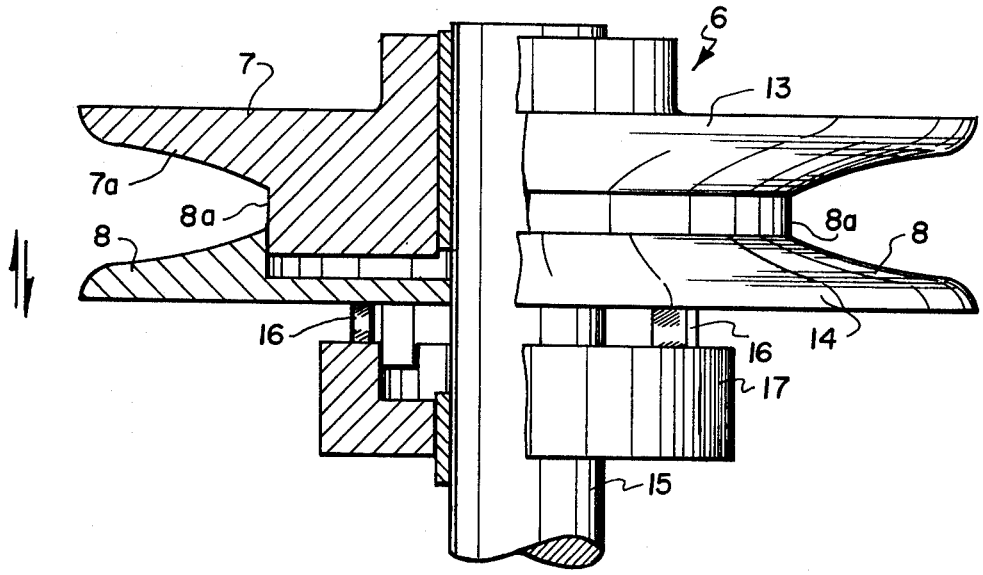
FIGS. 4 and 5 are respective front and plan views, partially in section, of a folding roller having an adjustable groove width.
Figure 5:
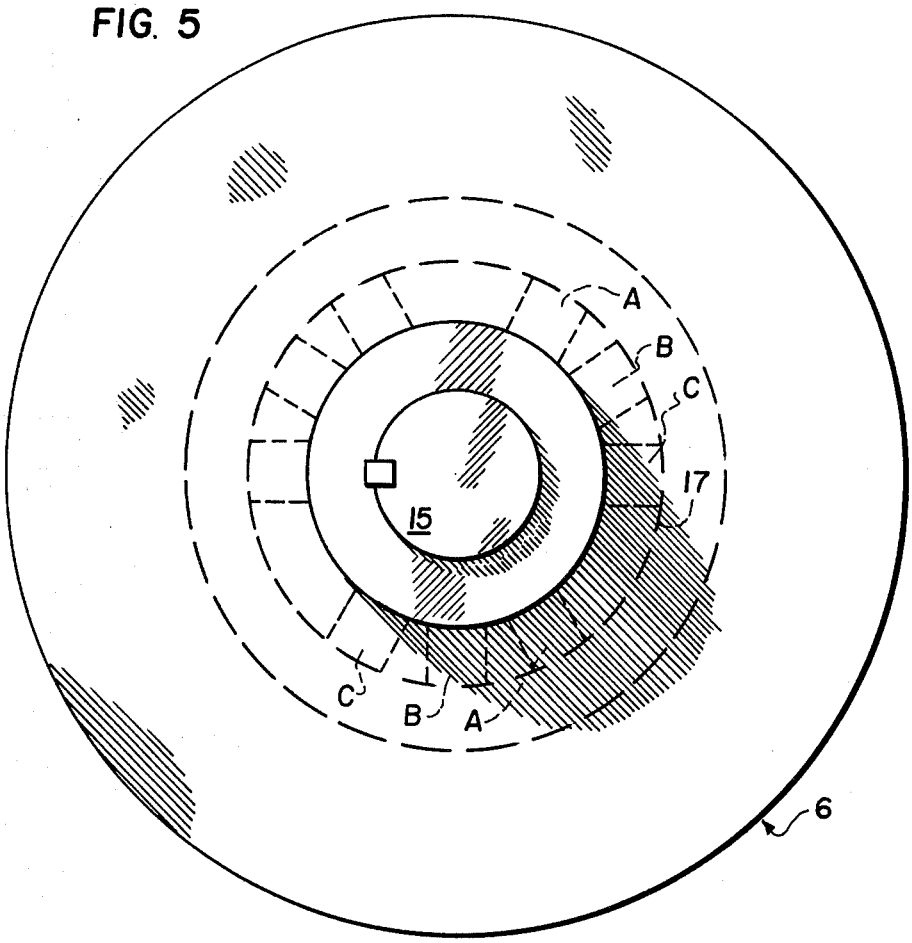
Figure 6:
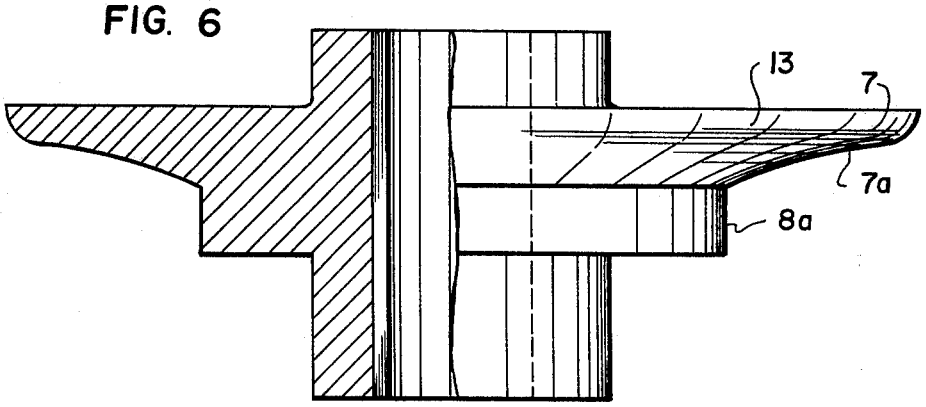
FIG. 6 is a partially in section front view of the upper portion of a folding roller.
Figure 7:
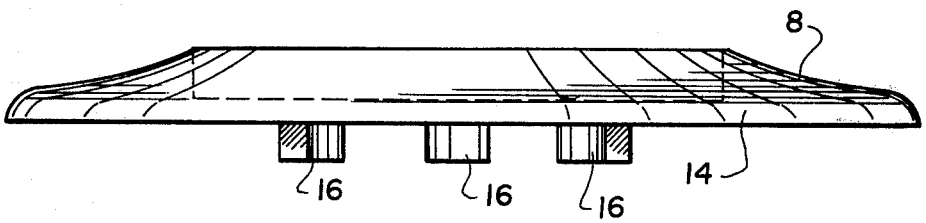
FIG. 7 is a front view of the bottom portion of a folding roller.
Figure 8:
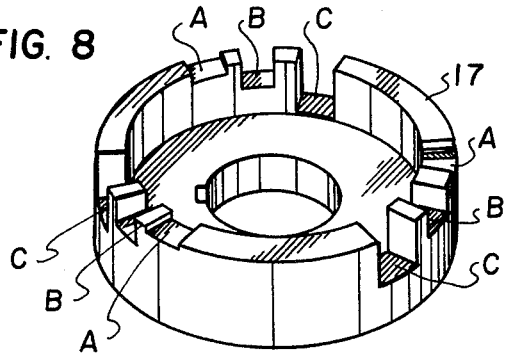
FIG. 8 is a perspective view of the annular adjustment member of a folding roller.

Referring to the drawings in particular, the invention embodied therein in FIG. 1, comprises a container blank 1 formed into a channel shape by a preceding process which is fed from the preceding process where its side flaps 2, 2 were folded downwardly at substantially 90° angles, along two parallel guide rails 4, 5 by a transferring belt (not shown), in the direction of the arrow. Arranged along the outside of guide rails 4 and 5 are multiple folding rollers 6-1, 6-2, . . . 6*n*, which are rotatably mounted at spaced positions. The roller group 6 is spaced from the rails 4, 5 and abut the container blank 1 on its folding score line or hinge 3, 3. The rollers 6-1 to 6*n* vary in shape in the advancing direction of container blank 1, as shown in FIG. 2. Specifically, the first roller 6-1 has a side face 8 which is at a right angle to the lower face 7*a* of substantially horizontal upper flange 7, and has a shape to control guidance of the container blank 1 on the rail 4. The subsequent folding rollers 6-2, 6-3, 6-4, . . . 6-*n* have inclined side faces 8 of an angle $\alpha$ being made successively smaller, 3.g., 75°, 55°, 40°, 35°, 30°, 25°, respectively, in the advancing direction of container blank 1. The final roller 6-*n* a horizontal U-shape folding groove having an opening substantially equivalent to two thicknesses of blank 1. The folding operation on container blank 1 by rollers 6 is as follows: Container blank 1 on which folding score line applying work has been completed is supplied to the folding device in a channel-shaped form having side flaps 2, 2 folded at right angles along both sides at score lines or hinges 3, 3. The container blank 1 reaches a position between right and left folding rollers 6-1, 6-1, and is held down on rails 4 and 5 by the lower face 7*a* of upper flange 7 of rollers 6-1, 6-1. Motion in a transverse direction is controlled by side faces 8. The container blank is then transferred toward a position between the next rollers 6-2, 6-2 and 6-3, 6-3. Side face portions 8 on rollers 6 are inclined and at an angle $\alpha$ and are formed so that the inclined angle becomes smaller on successive rollers. The flap portions 2, 2 at either side of the central portion 1*a* are thus folded toward the underside of central portion 1*a* as it advances on rails 4, 5, by decreasing angle $\alpha$ of side faces 8. Moreover, the container blank 1 is folded correctly along folding score lines or hinges 3, 3 by the cooperating action of parallel guide rails 4, 5, even if there is a weakness in the area of the folding score line 3, 3 of the blank 1, since the blank 1 is folded while its surface at central portion 1*a* is being held down by lower face 7*a* of upper flange 7 on each roller group 6. The transverse direction is controlled by partial vertical portion 8*a* of side face 8. The guide rails 4, 5 are not necessary all the way to the position of the final roller 6-*n*, since the folded blank is firmly positioned between the rollers.

Figure 14:
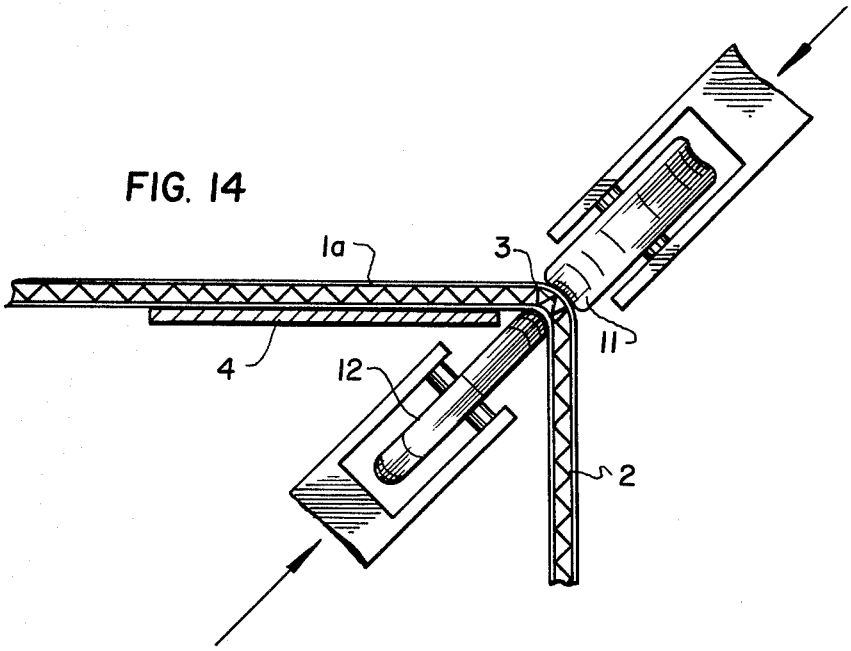
FIG. 14 is a plan view showing operational state of a score line treating device which is required when the container blank has a large thickness.
Figure 12:
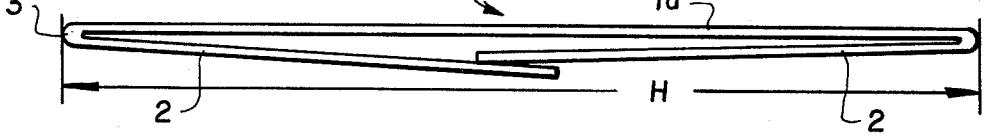
FIG. 12 is a front edge view of a container blank after a folding operation in accordance with the invention.
Figure 13:
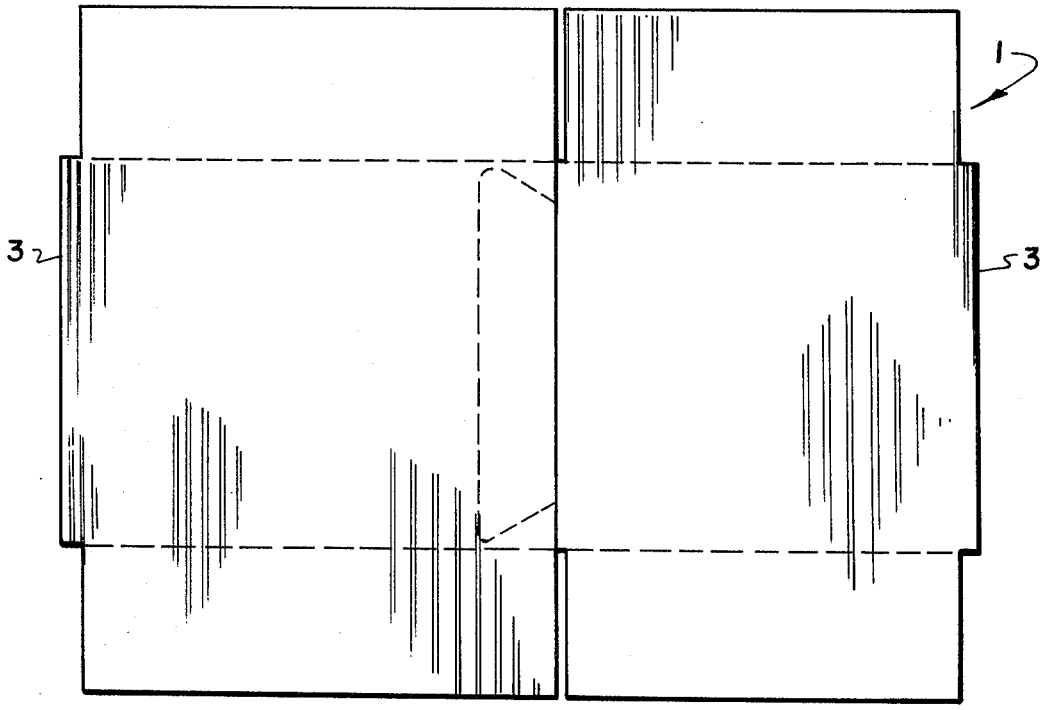
FIG. 13 is a plan view of a container blank after a folding operation in accordance with the invention.

Since both side flaps 2, 2 of blank 1 are folded substantially at 180° angle to the central panel 1*a* at the folding hinges 3, 3 when the thickness of the blank 1 is large, there is a possibility that breaking will occur along the hinges 3, 3. The effect can be obviated by providing a squashing device for the score lines or hinges 3, 3 between first roller 6-1 and second roller 6-2, as shown in FIG. 14. This breaking of the score line area can be prevented by arranging a pair of pressing discs 11 and 12 at opposite surfaces of the sheet 1 at folding score lines or hinges 3, 3. These discs somewhat squash the inner surface of score lines 3, 3 and widely squash the outer surface of score line 3, 3, in accordance with movement of blank 1.

A folding operation can be achieved when folding rollers 6-1 to 6-*n* are in a free rotating state, but it is favorable to positively rotate the roller group 6 at a peripheral velocity coinciding with the transfer velocity of blank 1 along rails 4 and 5 since friction between the roller group 6 and blank 1 can thus be reduced and a finer finish is realized on the folded container surfaces. It is preferable to make it possible to adjust the width of the groove openings on roller group 6 to accommodate various container blank thicknesses.

FIGS. 4 through 8 show one embodiment of the invention in which the folding rollers are provided with a groove width adjustment means, so that the width of the folding groove on the rollers acting in a folding operation can be adjusted to conform to various thicknesses of container blanks. Each roller is divided into two pieces along a horizontal axis at vertical portion 8*a*. An upper half portion 13 is fixed to a shaft 15 and a lower half portion 14 is fitted loosely about shaft 15 so as to be freely movable thereon. A plurality of projections 16, 16 are provided on the lower face of the lower half portion 14, and an annular adjustment member 17, having several indentations of different depth, A, B and C is fixed to shaft 15 below the lower half portion 14. To adjust the width of the folding groove, i.e., the exposed portion of 8*a*, projections 16 are selectively placed in respective indentations A, A, A; B, B, B or C, C, C, by rotating lower half portion 14 to the proper position and by dropping it into engagement with member 17.

Figure 9:
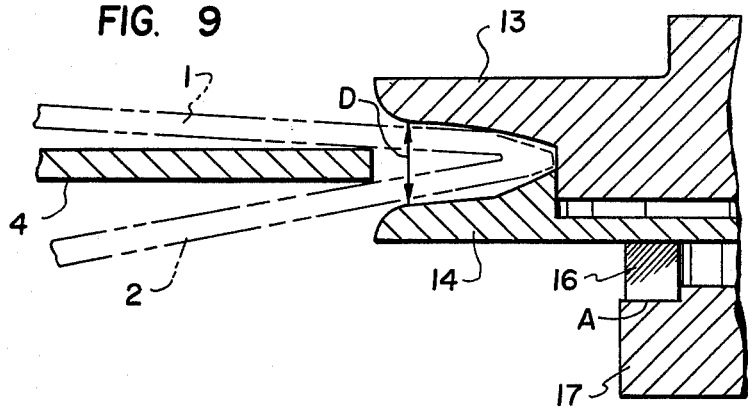
FIGS. 9, 10 and 11 are respective sectional views of folding roller adjustments to accommodate container blanks of varying thicknesses in a folding operation.
Figure 10:
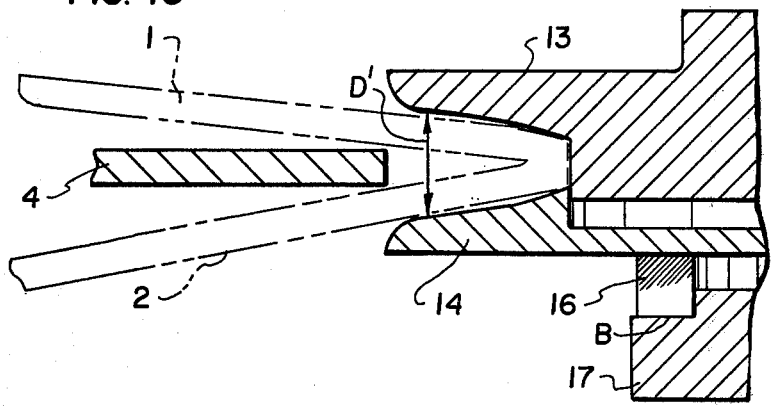
Figure 11:
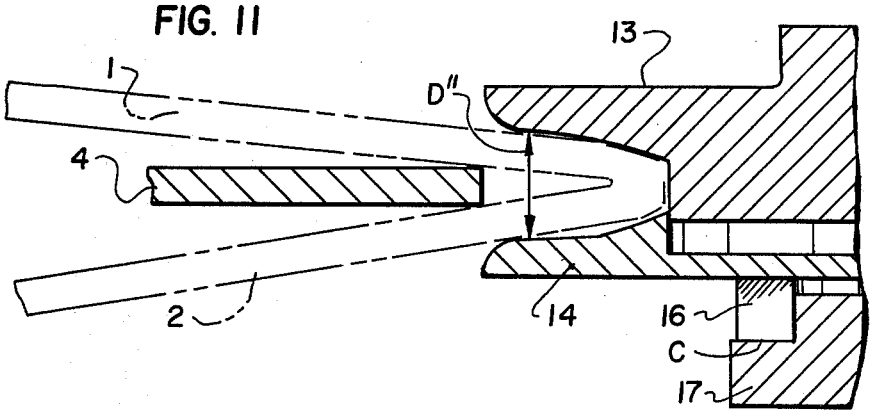

When blank 1, with a small thickness is to be folded, projections 16, 16 on lower half portion 14 of roller 6 are fitted to shallow indentations A, A on annular member 17, so that the lower half portion 14 approaches the upper half portion 13 to form a groove width of the dimension D, as shown in FIG. 9. If the thickness of blank 1 is somewhat larger, lower half portion 14 is turned slightly by raising this lower half portion 14 once and separating the engagement between projections 16, 16 and indentations A, A, then rotating 14 to place projections 16, 16 over indenations B, B and dropping it to form a groove width of a dimension D′, as seen in FIG. 10. When the thickness of blank 1 is large, projections 16, 16 are similarly positioned at deep indentations C, C, as shown in FIG. 11, so as to form a groove of still larger dimension D″. The exchanging of rollers 6 is unnecessary with changing container blank thicknesses when the above adjustment means is used in accordance with the invention.

Although the disclosed embodiment shows three sets of indentations A, B and C, it will be understood that the number of settings can be increased to accommodate a large variety of sheet thicknesses by placing a greater number of indentations around annular member 17.

While a specific embodiment of the invention has been shown and described in detail to illustrate the application of the principles of the invention, it will be understood that the invention may be embodied otherwise without departing from such principles.

I claim:

1. A device for folding at least one side flap of a container blank having a central panel and at least one side flap hinged to said central panel, comprising a guide rail over which said blank is movable having an edge positionable at the hinged connection of said panel to said side flap, a plurality of guide rollers arranged along one side of said guide rail each having a top flange overlying said rail and engageable over said central panel and a bottom flange disposed in spaced vertical relation to and extending inwardly at an angle to said top flange portions, the angle of said bottom flanges of respective adjacent rollers decreasing in the direction of movement of said blank and progressively engageable with said flap to fold it upwardly against said panel as said blank is moved along said rail.

2. An apparatus for folding container blanks having a central panel and opposite flap portions hinged to the central panel extending downwardly from the central panel, comprising parallel guide rails for supporting the container blank parallel to and adjacent the hinged connection of said panel and flap portions, the container blank being movable along said rails, a plurality of folding grooved rollers rotatably mounted on substantially vertical axes at spaced locations along said rails and each having top flange portions engageable with the top of the central panel adjacent the hinged connection of each flap portion to hold the blank downwardly on said rails and having lower portions spaced vertically from said top portions with side face surfaces engageable with the flaps adjacent the hinges, said lower portions being at an angle to said top flange portions, said angle decreasing on respective rollers in the direction of motion of the blank on said rails for folding the flaps back upon the central panel of the blank when the blank moves past said rollers on said rails.

3. An apparatus according to claim 2, wherein said folding grooved roller further comprises adjustment means between said top and lower portions for varying the depth between said top and lower portions to accommodate and fold container blanks of varying thicknesses.

4. An apparatus according to claim 3, wherein said adjusting means further comprises annular spaced projections on the bottom surface of said lower roller portion, said lower portion being rotatably mounted on said rotatable shaft, an annular member connected to said shaft below said lower portion, said annular member having annular spaced indentations facing said projections, selectively engageable with said spaced projections of said lower portion to adjust the depth between said lower and top roller portions.

5. An apparatus according to claim 2, wherein said rotatable shaft is driven at a rate equal to the linear rate of movement of the blank along said rails.

6. An apparatus according to claim 2, wherein said rotatable shaft is mounted for the free rotation of said rollers as the blank passes said rollers.

* * * * *